United States Patent [19]

Winfrey

[11] Patent Number: 4,751,862

[45] Date of Patent: Jun. 21, 1988

[54] JAW MEANS FOR TOGGLE ACTUATED COMPRESSION CLAMPING TOOL

[75] Inventor: James L. Winfrey, Crestwood, Mo.

[73] Assignee: Blackburn Company Div. of FL Industries, Inc., St. Louis, Mo.

[21] Appl. No.: 907,985

[22] Filed: Sep. 16, 1986

[51] Int. Cl.[4] ..... B25B 7/12

[52] U.S. Cl. ..... 81/348; 81/342; 81/350

[58] Field of Search ..... 81/348, 342, 350

[56] References Cited

U.S. PATENT DOCUMENTS 444,635 1/1891 Helwig ..... 81/348

*Primary Examiner*—Frederick R. Schmidt
*Assistant Examiner*—Maurina Rachuba
*Attorney, Agent, or Firm*—Laff, Whitesel, Conte & Saret

[57] ABSTRACT

An improved toggle actuated compression clamping tool having an improved pair of identical jaws using gear segments to obtain equal and opposite rotation of the jaws between open and closed relation. The gear segments are at least two in number on each jaw and are positioned coaxially adjacent one another but with the teeth of one segment offset from the teeth of the adjacent segment, thereby permitting two identical jaw members to make up an operative pair for the compression tool.

10 Claims, 1 Drawing Sheet

4,751,862

JAW MEANS FOR TOGGLE ACTUATED COMPRESSION CLAMPING TOOL

BACKGROUND OF INVENTION

In the field of electrical connectors there are a wide variety of compression fittings that are deformed by appropriate tools to insure a tight mechanical, as well as electrical, connection. As the cable size increases, the connectors as well as the tools increase in size and the latter require long handles to multiply the operating force by increasing the moment arms to which such a force is applied for the purpose of distorting or deforming the connector into positive mechanical as well as electrical contact with the cable.

Such a tool requires heavy duty, cast, or forged and finish machined jaw members. To insure symmetrical movement in equal and opposite directions about pivot points, such jaw members presently must utilize centrally located conjugate gear segments. However, in order to retain the jaws in proper relation and with such gears in mesh, it was found necessary to have both left and right hand versions of the jaws to insure proper symmetrical meshing of such gear segments.

SUMMARY OF INVENTION

It is an object of this invention to provide identical jaw means for use in a compression clamping tool of the type contemplated that will include means to insure equal and opposite rotation of a pair of jaw means about spaced pivot points.

It is a further object of the present invention to provide integral identical jaw means having two adjacent coaxially disposed gear segments on each jaw means.

Still another object of the present invention is to provide adjacent gear segments on each jaw wherein the gear teeth are offset, a tooth of one segment being adjacent an interstice of the adjacent segment.

Another object is to provide a single item of inventory wherein two identical parts can be used to make a pair of jaws with properly matched sectors of gears, thereby making manufacture of the tool a simpler procedure and hence more economical as well as insuring a quality product by using more inexpensive means for forming the jaw and by eliminating double tooling since only a single cavity mold is required for all jaws.

Other objects will become apparent to those skilled in the art when the accompanying specification is read in conjunction with the drawing.

DETAILED DESCRIPTION

Figure 1:
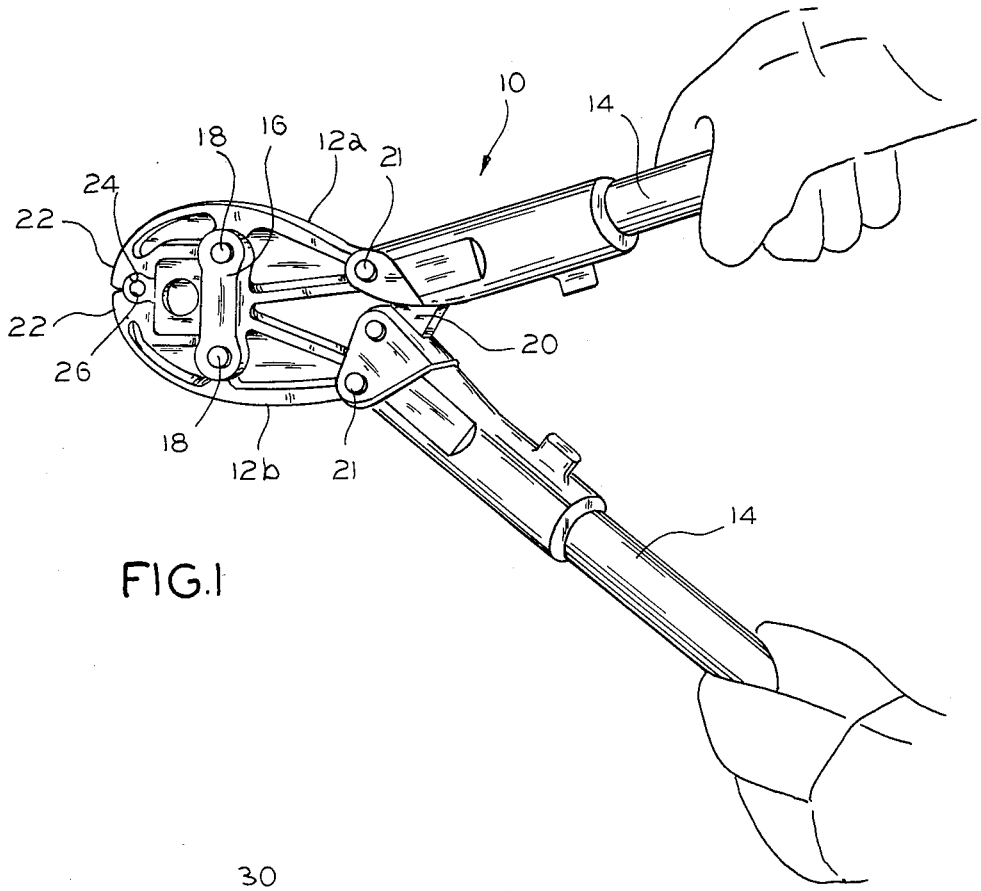
FIG. 1 is a perspective view of a compression clamping tool of the type generally contemplated by the present invention and showing the environment in which the improved jaw means is utilized.

Referring now to the drawing wherein similar parts are designated by similar numerals. A toggle actuated compression clamping tool 10 normally includes a pair of jaws 12*a* and 12*b*, a pair of elongated handles 14, a linkage 16 serving to carry a pair of pins 18, the purpose of which will be set forth hereinafter. (Preferably there will be two linkages 16 with one being positioned on the opposite face of the pair of jaws 12*a* and 12*b*.) The toggle actuated compression clamping tool 10 also will normally include suitable means such as an expanding toggle mechanism 20 for moving jaws 12 apart at their distal end while rotating the jaws about the pivot pins 18 to bring the clamping or anterior end 22 of the jaws 12 into juxtaposition. The ends 22 include a pair of opposing recesses 24 for accepting a connector and may have a chordal rib portion 26 that serves to distort the electrical connector (not shown) positioned within the opposing recesses 24 and retained therein while the chordal portion 26 bites into and distorts the connector into mechanical and electrical connection with a cable (not shown).

The prior art jaws had gear teeth extending across the entire face of the jaw member. As can be appreciated, this required two different jaw means since in order to have symmetrical rotation in equal and opposite directions it is necessary to have such gear teeth angularly offset relative to one another to permit interdental meshing of the gear teeth on one segment with the interstices of the other gear segment while still maintaining the longitudinal symmetry of the jaws when positioned in juxtaposed confrontation.

Figure 2:
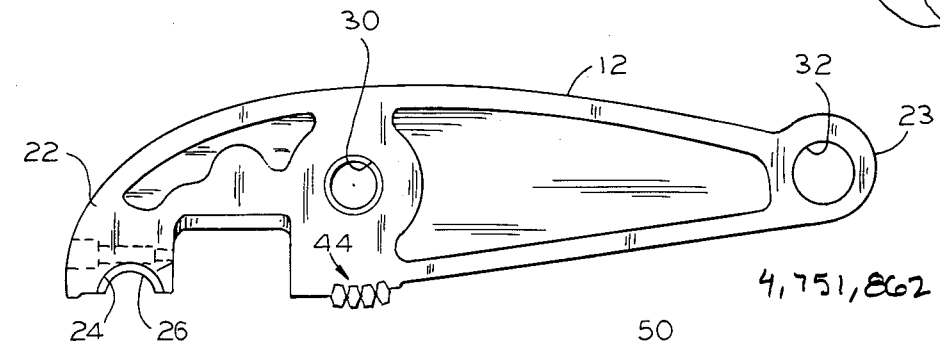
FIG. 2 is a front elevational view of a preferred embodiment of a of the type contemplated by the present invention.
Figure 3:
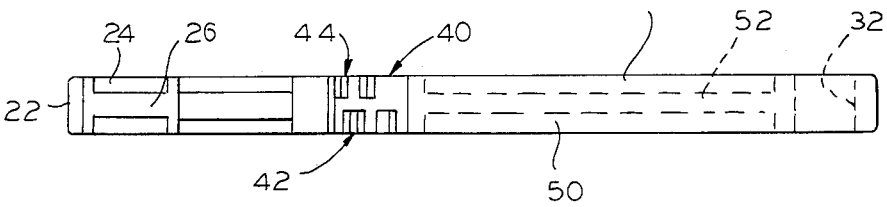
FIG. 3 is an edge view of the preferred embodiment as taken along line 3—3 of FIG. 2.
Figure 4:
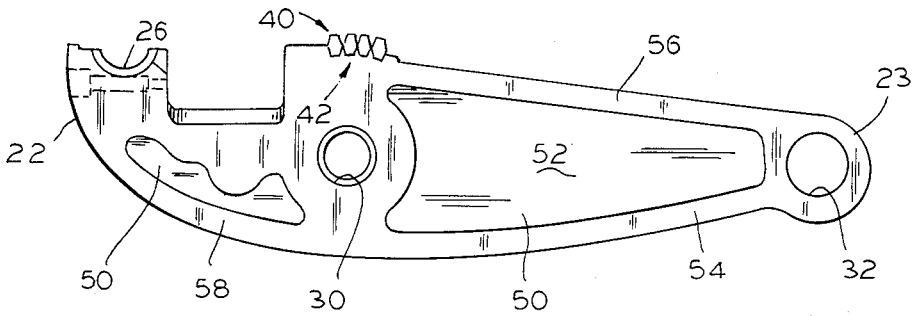
FIG. 4 is an inverted back elevational view of the jaw seen in FIG. 2, in its normal opposing position, but in spaced relation.

The jaws 12 of the present invention, as best seen in FIGS. 2–4, are identical members having an anterior end 22 and a distal end 23. There are at least two through bores in each jaw, the first bore 30 being generally intermediate the ends 22–23 and each adapted to accept one of the pins 18 associated with linkage 16. The second bore 32 is adapted to accept one of the pins 21 associated with expanding toggle mechanism 20, the latter mechanism being adapted to move the distal ends 23 of jaws 12 away from one another by pivoting the jaws 12 about pins 18, thereby bringing the anterior ends 22 into juxtaposed relationship.

In these improved jaws, as contemplated in the present invention, the symmetry of movement of the jaws 12, about the spaced pins 18, in equal and opposite directions, is insured by the gear means 40. These gear means 40 include a pair of adjacently positioned conjugate gear segments 42, 44. As can be best seen in FIG. 3, the teeth of the segments are angularly displaced relative to one another so that a tooth in one segment is aligned with an interstices of the adjacent segment. Therefore, any pair of these identical jaws will mate and cooperate. This results in a large saving since it no longer is necessary to stock left and right hand versions of jaws, as was necessary in the prior art. A single tool can be used for manufacture, all jaws are interchangeable and the disposition of the pitch diameter of the gears defines one-half of the distance between pins 18 as retained by linkage 16 thereby insuring coaxial disposition of the gear segments 42–44.

Jaws 12 can be investment cast by the well-known lost wax method with accurate definition of the gear segments 42–44 resulting therefrom. The overall weight of the jaw can be reduced by providing surface recesses 50, web 52 and perimeter ribs 54, 56 and 58 thereby insuring adequate strength.

Other advantages will be apparent to those skilled in the art.

I claim:

1. An improved toggle actuated compression clamping tool having a pair of identical an interchangeable jaw means, said jaw means including pivot means and integral mating means for insuring equal and opposite rotation of said jaw means about said pivot means, said integral mating means including at least two side by side cooperating means segments, said cooperating means segments being offset wherein said cooperating means segments on each jaw engage the cooperating means segments on the other jaw when a pair of said jaws are brought into confronting relationship.

2. A tool of the type claimed in claim 1 wherein said jaw means includes at least two pivot means.

3. A tool of the type claimed in claim 1 wherein said jaw means are one piece metallic elements.

4. A tool of the type claimed in claim 3 wherein said jaw means are investment cast elements.

5. An improved tool of the type claimed in claim 1 wherein each of said pivot means of said jaw means includes a through bore adapted to accept pin means about which it can freely rotate.

6. An improved tool of the type claimed in claim 5 wherein said pin means are two in number, means for fixedly retaining said pin means in predetermined spaced parallel relation to provide said pivot means about which said pair of jaws can symmetrically rotate.

7. An improved tool of the type claimed in claim 6 wherein said integral means for insuring equal and opposite rotation of said jaws about said pivot means are gear means.

8. An improved tool of the type claimed in claim 7 wherein said gear means are disposed on each jaw on a quadrant coaxially oriented about said pivot means, the pitch diameter of said gear means falling substantially on a line one-half the combined distance between said pivots.

9. An improved toggle actuated compression clamping tool having a pair of identically configured jaw means, said jaw means including pivot means and intergral mating means for insuring equal and opposite rotation of said jaw means about said pivot means, each of said pivot means of said jaw means including a through bore adapted to accept pin means about which it can freely rotate, said pin means being two in number, means for fixedly retaining said pin means in predetermined spaced parallel relation to provide said pivot means about which said pair of jaws can symmetrically rotate, said integral means for insuring equal and opposite rotation of said jaws about said pivot means being gear means disposed on each jaw on a quadrant coaxially oriented about said pivot means, the pitch diameter of said gear means falling substantially on a line one-half the combined distance between said pivots, said jaws being identical, said gear means on each jaw including at least two side by side gear segments having their respective teeth and interstices offset one pitch whereby when a pair of such jaws are brought into confronting relationship the gear segments will mesh and insure equal and opposite rotation of said jaws about said spaced pivot means.

10. An improved tool of the type claimed in claim 9 wherein said jaws each include a pair of pivot means, the aforementioned pivot means being located intermediate the ends of said jaws, the second pivot means being located adjacent one end of said jaws to permit application of force means to said jaws and to cause rotation about said first mentioned pivot means and gripping means at the opposite end of said jaws for gripping a workpiece.

* * * * *